US009067755B2

(12) United States Patent
Barea

(10) Patent No.: US 9,067,755 B2
(45) Date of Patent: Jun. 30, 2015

(54) MODULAR ELEMENT OF CREEL

(75) Inventor: Tiziano Barea, Busto Arsizio (IT)

(73) Assignee: BTSR INTERNATIONAL S.P.A., Olgiate Olona (VA) (IT)

( * ) Notice: Subject to any disclaimer, the term of this patent is extended or adjusted under 35 U.S.C. 154(b) by 437 days.

(21) Appl. No.: 13/508,267

(22) PCT Filed: Nov. 18, 2010

(86) PCT No.: PCT/IB2010/002948

§ 371 (c)(1),
(2), (4) Date: May 4, 2012

(87) PCT Pub. No.: WO2011/061602

PCT Pub. Date: May 26, 2011

(65) Prior Publication Data

US 2012/0217337 A1 Aug. 30, 2012

(30) Foreign Application Priority Data

Nov. 20, 2009 (IT) ..... MI2009A002042

(51) Int. Cl.
*B65H 49/16* (2006.01)
*B65H 63/08* (2006.01)

(52) U.S. Cl.
CPC ..... *B65H 49/16* (2013.01); *B65H 63/086* (2013.01); *B65H 2402/10* (2013.01); *B65H 2701/31* (2013.01)

(58) Field of Classification Search
USPC ..... 242/418, 418.1, 551, 563, 555, 555.3, 242/555.4, 564.3, 594.3–594.6, 131–131.1
See application file for complete search history.

(56) References Cited

U.S. PATENT DOCUMENTS

| | | | |
|---|---|---|---|
| 3,432,117 | A | 3/1969 | Leger |
| 3,452,947 | A | 7/1969 | Thurman |
| 4,685,633 | A | 8/1987 | Pellini |
| 6,116,292 | A | 9/2000 | Vermeulen |
| 6,676,054 | B2 | 1/2004 | Heaney et al. |

(Continued)

FOREIGN PATENT DOCUMENTS

| | | | |
|---|---|---|---|
| EP | 1909052 | A1 | 4/2008 |
| FR | 2575872 | A1 | 7/1986 |

(Continued)

OTHER PUBLICATIONS

International Search Report dated Jan. 14, 2011 from PCT/IB2010/002948.

(Continued)

*Primary Examiner* — William E Dondero
(74) *Attorney, Agent, or Firm* — Novak Druce Connolly Bove + Quigg LLP

(57) ABSTRACT

A modular element of creel including a structure having at least one support suitable to support a reel or yarn spool; the structure is in the form of a solid polygon and includes a feeder device suitable to allow the feeding of the thread developed by such spool with at least one characteristic, selected from the characteristics of tension and speed, maintained constant and equal to a preset fixed value or function of the operational phase of the machine. The structure is able to be modularly coupled to other similar structures to allow the feeding of more yarn to a textile machine. Every yarn fed by every modular element having its own selected characteristic defined by the feeder device associated with such modular element.

17 Claims, 4 Drawing Sheets

(56) References Cited

U.S. PATENT DOCUMENTS

| | | | | |
|---|---|---|---|---|
| 2001/0037545 | A1 | 11/2001 | Stuttem | |
| 2002/0161470 | A1 | 10/2002 | Kusuzono et al. | |
| 2007/0084960 | A1* | 4/2007 | Heaney et al. | 242/551 |
| 2007/0152093 | A1 | 7/2007 | Hartzheim | |
| 2008/0173742 | A1* | 7/2008 | Chadwick | 242/130 |
| 2008/0283653 | A1 | 11/2008 | Bing-Wo et al. | |
| 2009/0142497 | A1 | 6/2009 | Suda et al. | |

FOREIGN PATENT DOCUMENTS

| | | | |
|---|---|---|---|
| GB | 1202991 | A | 8/1970 |
| JP | S5255755 | A | 5/1977 |
| JP | 2003526584 | A | 9/2003 |
| JP | 2007032897 | A | 2/2007 |
| WO | 97/39171 | A1 | 10/1997 |
| WO | 00/21866 | A2 | 4/2000 |
| WO | 2008131252 | A1 | 10/2008 |

OTHER PUBLICATIONS

Japanese Notification of Reason for Rejection to Japanese Application No. 2012-539428 dated Apr. 15, 2014.

* cited by examiner

MODULAR ELEMENT OF CREEL

CROSS-REFERENCE TO RELATED APPLICATIONS

This application is a §371 National Stage Application of International Application No. PCT/IB2010/002948, filed on18 Nov. 2010, claiming the benefit of Italian Patent Application No. M12009A 002042 filed on 20 Nov. 2009.

Forming the object of this invention is a modular element for creel.

As is known a creel is a structure suitable to hold a plurality of spools or reels which develop direct threads to a textile machine for its work, such as for instance a production line for diapers.

Modular creels are known presenting a plurality of supports which may be coupled together and carrying a further plurality of mobile pins on which the spools can be arranged; such pins facilitate the loading of the reels. Thread guides are also associated with such supports that allow directing the threads in a guided fashion, which are develop from the reels, to a textile machine.

Such modular creels can form cabinets of various dimensions, ventilated or not. Such structures, nevertheless, are of large dimensions, with vertical development, and do not include devices to check the tension and speed characteristics of the threads. This constitutes a real drawback of the known creels insofar, as is known, a thread used by a textile machine for the production of a manufactured article preferably should be supplied to such machine with a constant speed and/or tension so as to allow a production free from defects. For such reason devices are already known that allow obtaining such feeding at least at constant tension.

Such devices are commonly used to guarantee the quality of a textile production process; this due to their ability to allow a yarn feed to a textile machine in real time at constant tension.

GB1202991 describes modular creels which may be coupled together and carrying a plurality of arms suited to support the corresponding yarn spools. The thread is taken from these spools and sent to a textile machine such as a tufting machine or similar. It is planned that the end part of a thread wound on a first spool is connected to the initial part of a second spool, placed in proximity to the first so as to allow a continuous feed or "head-tail" of the thread to the textile machine and the replacement of the first spool, when the thread has run out, with a fresh full spool.

In the British prior document the modular creels present arms supporting the spools that are fixed to respective posts of each creel. Because of this, in the case in which the arms are placed at relatively high heights of modularly overlapped creels, the replacement of the empty spools with full ones is difficult, even if an aisle or passage is provided between the creels leaning on a common support plane to allow an operator to move between them.

Besides, the modular creels act from simple support of the spools and they do not have any device for the tension or speed control of the thread fed to the textile machine. The possibility to arrange such a device for each creel of the modular creels structure is neither described, nor suggested. The arrangement of such a control device indicated above cannot even be provided because the spools prepared on a first post are turned toward the spools supported by a second post which faces the first one, and the supported threads are fed in opposite directions between them and in overlapping relationship (see FIG. 2 of GB1202991). Between such posts and spools facing each other, therefore, there is not even the space to insert a device suitable to control and/or adjust the tension and the speed of every thread fed.

U.S. Pat. No. 6,676,054 concerns a device to unwind an elastomer thread from a spool according to a head-tail type thread feeding method and that connects the thread tail from one spool with the thread head from another spool. These spools are supported by pins in association with posts defining a structure of definite and considerable dimensions.

The United States patent foresees that the above quoted structure supports a plurality of yarn spools, but a single device for constant velocity feed of the threads. For such reasons a control is not possible for regulation of the feed velocity for each thread, nor may different speeds be foreseen for different threads fed. This characteristic can be important when for a textile machine, that works on a plurality of threads, they must be fed in discontinuous fashion or with different speeds, for instance when different counts are fed on different positions of the creel, that therefore require different tensions so as to attain the desired drawing of the thread and consequently different feed velocities.

Additionally, the aforesaid patent foresees that the constant feed velocity must be synchronized with the textile machine with the purpose of following, where present, the acceleration and deceleration phases of this machine.

The American prior document finally, describes respectively distance and angle measurements relative to a first yarn guide and to the thread spools (distance) and to the yarn guide and the spool rotation axis (angle) so as to contain the tension variation on output within acceptable limits independently of the fact that the spool from which it is developed is either full or empty.

The technical problem that this invention seeks to resolve is to offer a modular creel element of contained dimensions and which may be easily coupled to identical elements so as to be able to define creels of different dimensions and containers and/or supporting any number of spools or reels, said modular creel element also including a suitable device to control and to make at least one characteristic constant, between the tension and the speed, of the thread that is developed or unwound from a spool supported by the element of same creel.

One additional purpose the invention proposes is to offer a modular creel element that can allow the feeding of the thread with the head-tail type mode.

One additional purpose is to foresee on said creel a suitable system to intercept the reel change, to signal to the operator the need to load one or more spools.

Another purpose is to offer a modular creel element that resolves the technical problem to allow the easy movement and replacement of the spools, both manually and automatically.

These and other purposes that will turn out to be evident to the expert from the field are attained by a modular element according to the attached claims.

For a proper understanding of this invention are attached under purely illustrative, but non restrictive heading, the following diagrams, in which.

Figure 1:
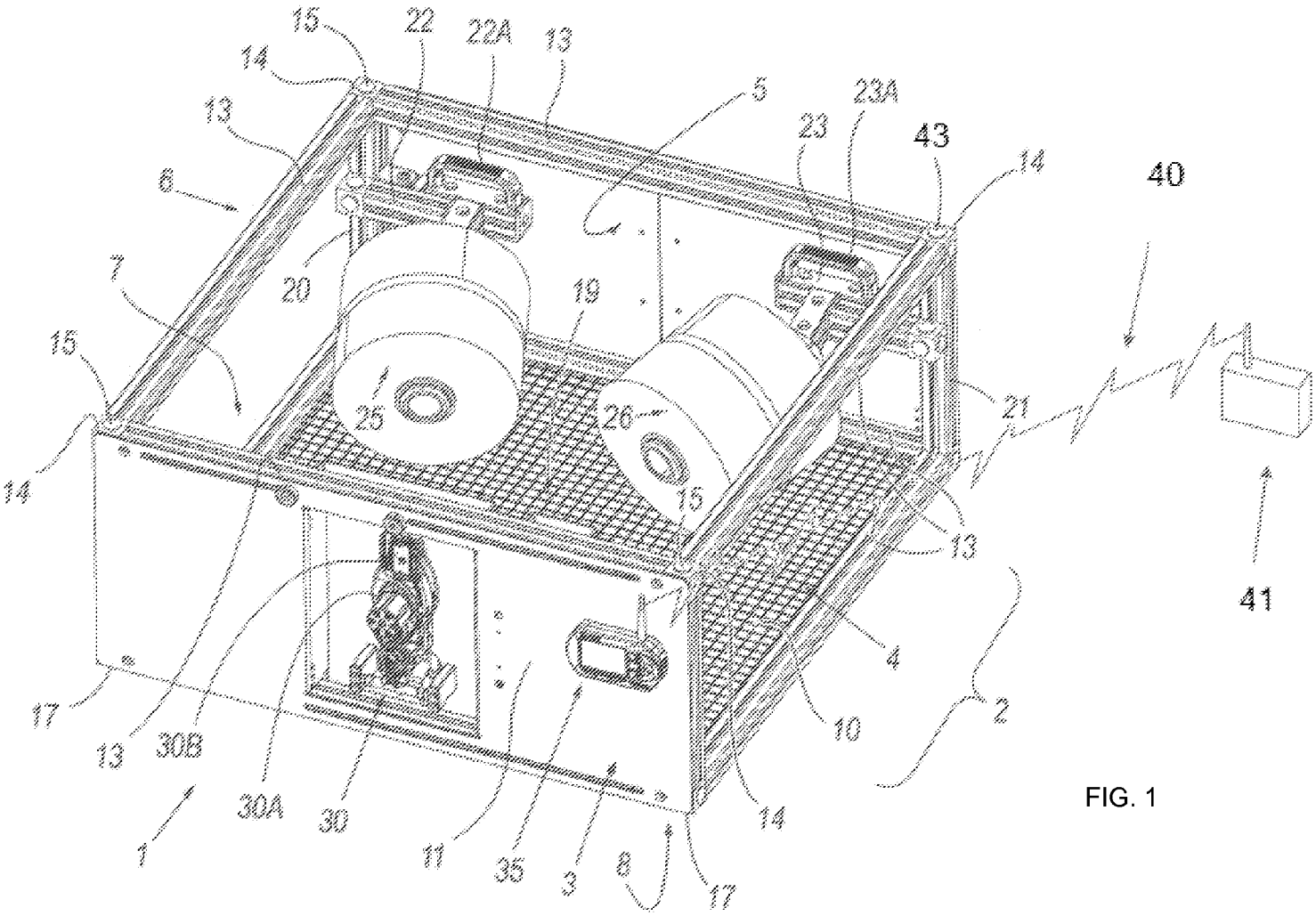
FIG. 1 shows a frontal perspective view of a creel element according to the invention.
Figure 2:
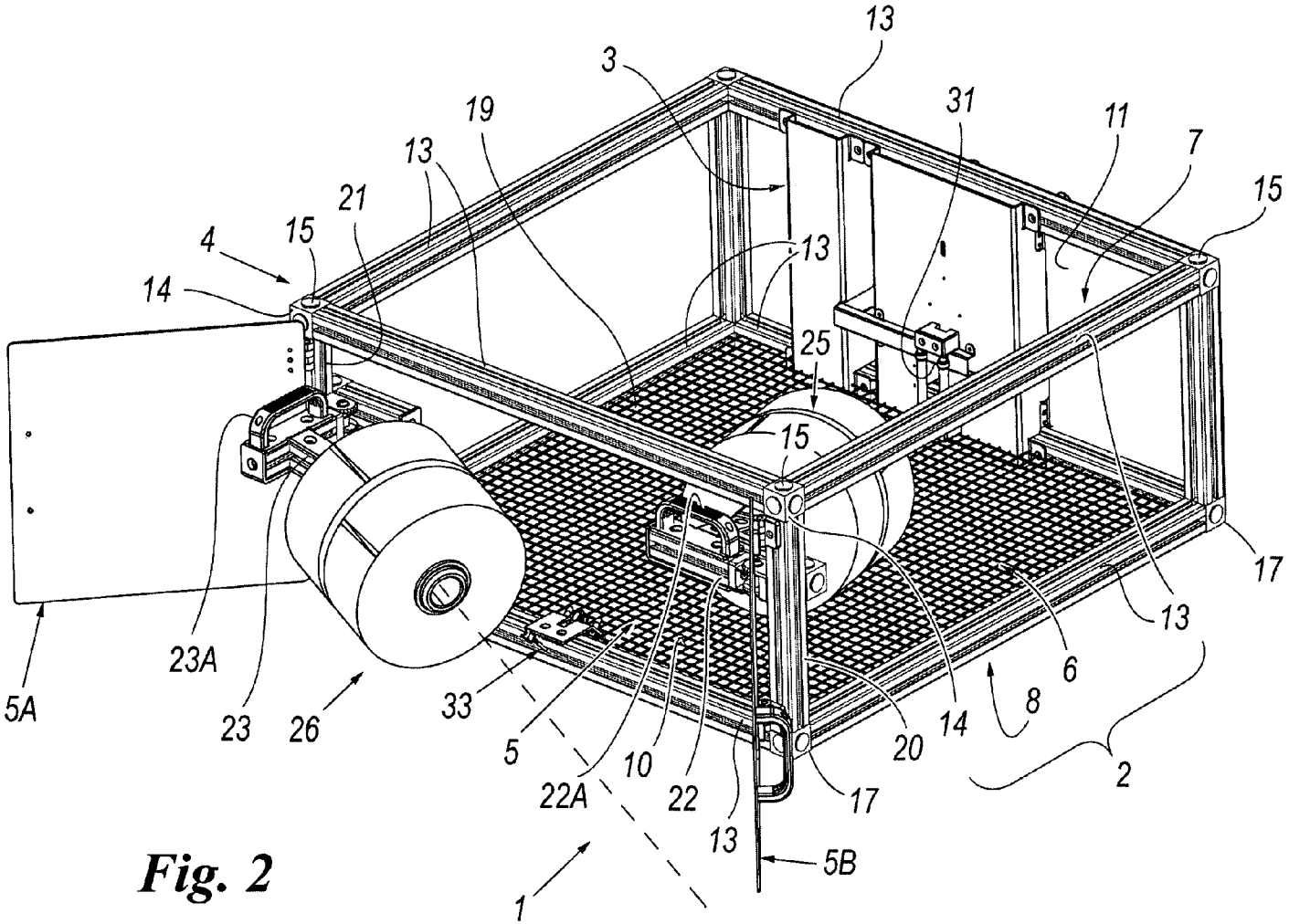
FIG. 2 shows a perspective view from the back of the creel element of FIG. 1 in one of this usage or operating phases.

With reference to the cited figures, a modular creel element is generically indicated in 1 and includes a structure 2 (in the example with solid polygon) with opposite sides 3 (front), 4, 5 (back) and 6, an upper 7 and lower 8 face; the lower face 8 can be defined from a flat grid 10 or, alternatively, transparent while the front side 3 supports a plane 11 the function of which will be described subsequently. The function of plane 10 will be subsequently described.

Figure 3:
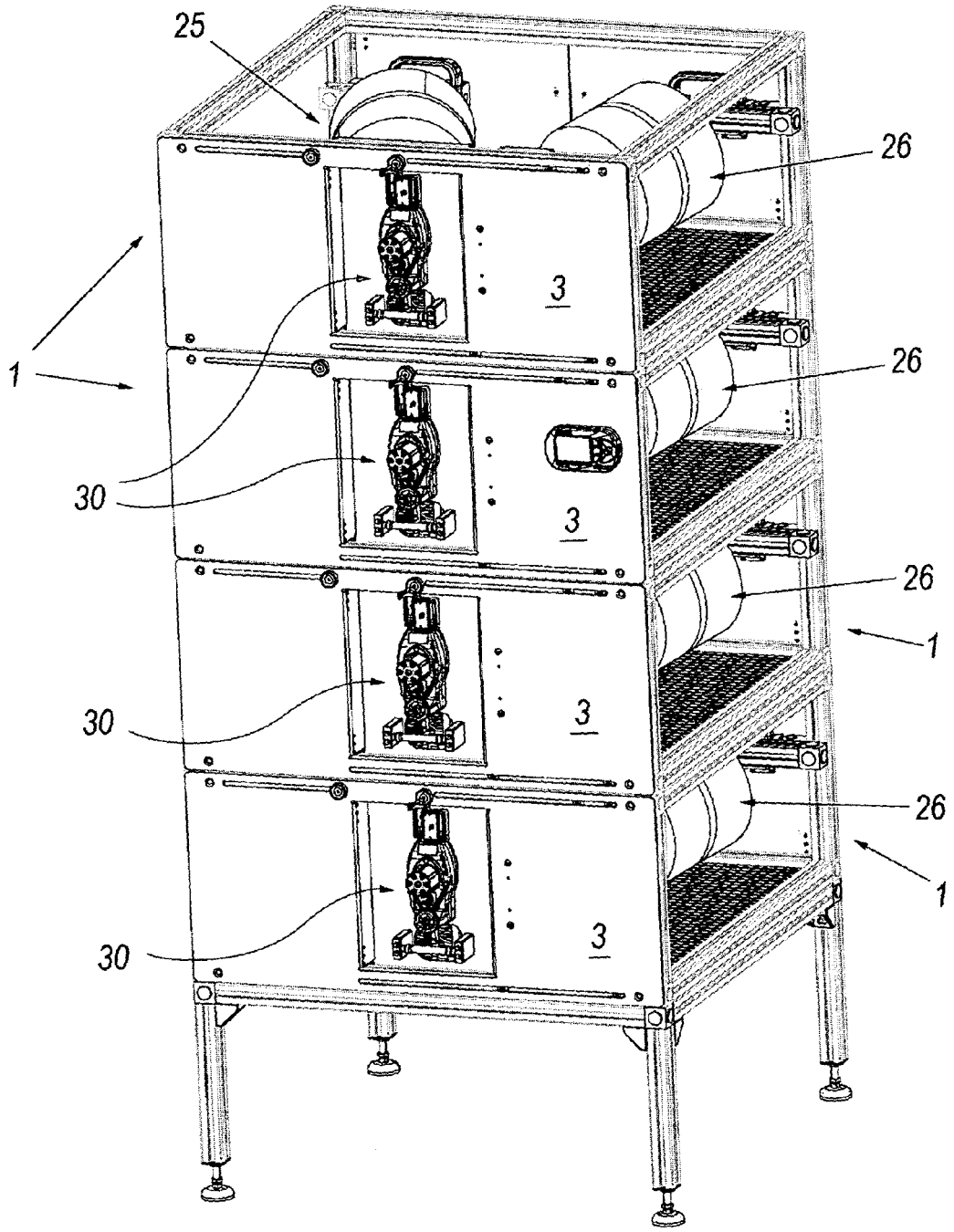
FIG. 3 shows a front perspective view of a structure including a plurality of creel elements of the type shown in FIG. 1.
Figure 4:
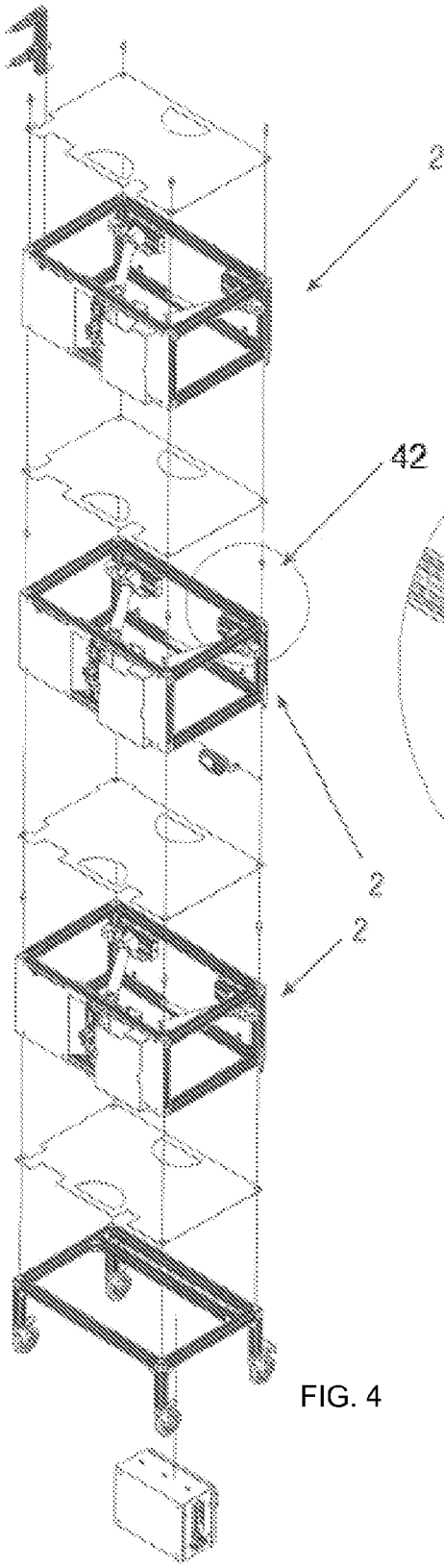
FIG. 4 shows an exploded front perspective view of a structure including a plurality of creel elements.
Figure 5:
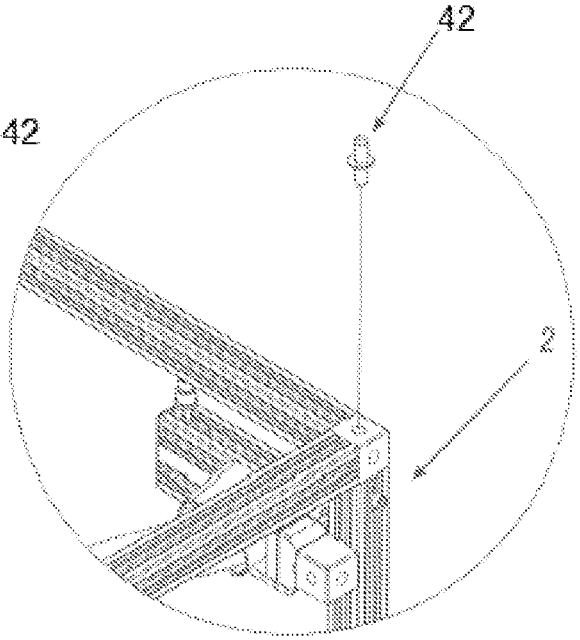
FIG. 5 shows a close-up view of a corner of a creel element, having a pin for connection to other creel elements.

The structure 2 is delimited in particular by sections (or profiles) 13 mechanically coupled together. In correspondence to the corners 14 of the upper face 7, in one embodiment, seats or recesses 15 are provided, while pins 42 protrude lower down from corners 17 of the lower face 8 (as shown in FIG. 4 and FIG. 5). This allows overlapping stably (or placing side by side) two identical structures 2 inserting the aforesaid pins of the face 8 within the seats 15 of that face 7 (as shown in FIG. 3). Obviously other devices may be provided for connecting between identical structures 2, other than mechanical ones (such as magnetic coupling devices 43) that also permit the lateral connection of the structures.

The whole of the structures can constitute a complex matrix or "molecular" structure where the individual "atoms" are constituted by the structures 2 coupled together.

At side posts 20 and 21 of the rear side 5 of the structure 2 arms 22 and 23 are located, respectively, hinged preferably to such posts and provided with hand grips 22A, 23A. Said arms, that can rotate inside and outside of an internal cavity 19 of the structure 2, are suitable to support at least one spool or yarn reel 25 and 26. Due to such movement, an operator can easily replace the empty spools with full spools or intervene on the thread if it broke during feeding.

The spools 25 and 26, when in working position (FIG. 1) inserted in the hollow 19, present the respective threads connected together with the "head-tail" method or, the start of the thread from spool 26 is connected to the "tail" or end of the thread of spool 25. The head of the thread of the latter is connected to a feeder device of the thread, known in itself, 30 associated with the plane 11 connected to the front side 3 of the structure 2, said thread for instance passing through a hole 31 provided in such a plane to reach said feeder device 30. The latter is preferably of the type suitable to feed the thread to a textile machine, in continuous or discontinuous fashion, with constant tension and/or speed, said control is effected by this same device 30. Obviously, this device can be set in another position on the structure 2.

The feeder device introduces, in a known fashion, a rotating actuator 30A connected to a control unit for the operation of the device 30 (not shown) and a tension sensor device 30B. Such sensor device and said actuator, together with the control unit, define a closed control loop for the feeding of the thread.

In correspondence to a section 13 peripherally delimiting the rear side 5 (preferably closed by doors 5A, 5B which may be opened with handle) a sensor device is present 33 suited to receive, passing through, the tail of the thread from spool 25 connected to the head of the thread from spool 26 (or vice versa). Such a device 33 is preferably connected to the control unit of the feeder device 30. The sensor device 33 can be provided with a yarn guide (for instance open) and be embodied in such a way as to allow the feeding of the device 30 with the thread from spool 26 when the thread from spool 25 runs out.

In such a case, the thread fed (coming from the full spool 26) is released from the sensor device 33 and this causes the device to produce a signal sent to a control unit 35 (possibly inserted into device 30 and coincident with or connected with such unit of said device 30 via a connection 40, which may be a serial connection obtained via a wireless connection) with display associated with the structure 2 that supervises the operation of the modular element 1 in all its components (spools and device 30). Such signal produces, therefore, in the unit 35 a warning that the spool 25 has run out, which activates an alarm signal, visual and/or auditory (not shown), so as to involve the intervention of an operator.

The operator removes the arm 22 carrying the empty spool 25 from the hollow 19 of the structure, rotating it around the respective post 20. This arm is arranged externally in the hollow so that what remains of the spool can be removed (the usual tubular support for the thread) and a new full spool 25 can be inserted on it.

Once the arm 22 and the new spool (25) are reintroduced into the hollow 19, the head or start of the thread supported by spool 25 is connected to the tail of the thread of spool 26. All of this without stopping the feeding of the thread that is developed from this latter to the device 30 and therefore toward the textile machine to which such thread is directed.

Naturally the device sensor 33 is "rearmed" by making the thread tail of spool 26 or the thread head of the new spool 25 pass through it.

With the purpose of increasing the productive potential, on each arm 22, 23 more spools can be arranged (as in the figures, where on the arm 22 two spools 25 are placed and on the arm 23 two spools 26) whose threads are connected with a head-tail tie (as explained further above). Obviously the free head of one of the two spools present on a first arm is connected to the tail of one of the two spools present on the second arm (or vice versa), in analogous mode to those already described.

Due to the invention, a creel of any dimensions can be obtained, chosen at will based on the operation of the requirement, by simply overlapping or placing side by side to each other a plurality of elements 1 (possibly and preferably they may be also mechanically coupled together through clamps, screws or bolts or male/female or magnetic couplings).

The creel thus obtained includes a plurality of autonomous elements, independent both from the point of view of the spools they support (and replaceable independently between them without stopping the operation of the textile machine to which a plurality of threads is fed coming from the plurality of coupled creel elements) and from the point of view of the control of the feeding of the thread from each modular element.

The aforesaid creel, therefore composed from the elements 1 each capable to feed a single thread, allows a greater flexibility both in the production phase (production of a single element, always equal) and for the client that can add or remove an element without having to disturb the entire creel. Each of the elements of creel 1, includes besides the means (the sensor device 33 or analogous elements to detect the presence of the thread on the spool, including optical ones) to detect the end of the thread from a spool (or from a plurality of spools in association with an arm, either fixed or preferably and advantageously mobile 22 or 23) and to advise that, precisely, one spool (or plurality of spools) is to be replaced with a thread load.

Every element 1 foresees an independent feeding device of the thread at constant tension, comprising a motor, a control electronics and a tension sensor. Such an element 1 is therefore capable to feed said thread independently at constant tension under the outline conditions (varying frictions, differences of tension on input between full spool and empty spool, absorption of speed variations, . . . ). It is therefore an element 1 that works in closed loop keeping the output tension constant, with consequent increase in the finished product quality. Since every element is equipped with a "smart" and independent feeding device (it operates in closed loop), it does not require any synchronization with the textile machine to which the thread is fed and is able to follow autonomously every speed variation of the production process with consequent marked simplification of the process itself.

Every element 1 is besides equipped with a smart and independent feeding device (it works in closed loop) it is possible to plan for every element of a modular creel (including a plurality of such creel elements) and therefore for every thread fed to a textile machine, different job tensions and therefore different drawings, allowing maximum flexibility and therefore the creation of innovative articles. Such predetermined tensions could be constant for the entire job or based on the operational phase, there could be for instance a lower tension for the first feeding phase (start up of the machine) and, after a certain time after the start of the feed or a certain amount of thread fed or after a preset feed velocity, such tension could pass to a second value (generally higher) for the production phase; this in fully automatic fashion. The tensions could also vary during the production phase for instance following a pre-determined profile based on the manufactured article.

Due to the use of a smart feeding device in association with every modular creel element and independent with respect to other modular elements, it is therefore possible to apply to the feeding of the thread a second control loop keeping constant not only the output tension of the creel but also the tension of the thread close to the insertion point of said thread into the production process. This for instance according to the text of EP1901984.

The invention operates therefore in closed loop on the tension, therefore guaranteeing a greater precision of the control and it does not necessarily have to have any interfacing with the textile machine, simplifying therefore the installation and the management of the entire system; which is different for instance from U.S. Pat. No. 6,676,054.

Additionally, with the invention there is the possibility to manage, in a creel with more elements 1, each "module" in independent fashion, planning therefore different tensions and drawings for every thread; this unlike U.S. Pat. No. 6,676,054.

Finally, the invention of this document is completely different from what is described in U.S. Pat. No. 6,676,054 where it is proposed keeping the output tensions within acceptable values working on the positioning of the reels and on the input angles; the invention of such priority is not capable of compensating sudden variations of the input tension (tugs coming from the reel) that inevitably again impact on the output tension. The invention of this document unlike that of the USA text cited above, in fact guarantees a constant tension and consequently a constant drawing on output using a closed loop feed system and therefore completely independent from positioning angles and distances of the reels.

Obviously, the creel element 1 described can also contain in its hollow 19 a single spool (or plurality of spools) supported by a mobile or fixed arm solidly attached to the structure 2 of such element. Obviously such an arm can also be external to the structure 2.

An element 1 of the described type, if connected through the unit 35 to a control unit of the textile machine, can stop this latter in the case of a rupture is detected of the thread fed to the device 30, a wrong feed tension or the lack of thread on the sensor device 30, guaranteeing a constancy in the production quality of manufactured articles and avoiding additional costs connected to possible defects noted on the products after their realization.

Note that the plane 10 functions as of separation and protection element between overlapped structures 2 suited to prevent that the yarn spools or the yarn itself of a first structure 2 can interfere with the functionality of the underlying or in general adjacent element 1.

Additionally, the information detected by the sensor 33 and sent to the unit 35 (external to the device 30 or part of it) it can be sent to a remote control unit suitable to collect the information of the end of thread occurring on one spool (25, 26) and the start of using the thread from the other spool (25, 26), said information being used for producing a warning of end of thread on such spool and to activate an automated device for replacement of the finished spool, the information being also usable to gather data related to the number of spools used and finished or to associate the production batch with a particular batch of thread to guarantee the traceability of what is produced.

A preferred embodiment of the invention has been described. Still others are possible in the light of the foregoing description and should be considered to fall within the scope of the claims that follow.

The invention claimed is:

1. Modular element of creel including a first structure having at least one arm mobile in association with the first structure, wherein the at least one arm is adapted to rotate inside and outside of an internal cavity of the first structure, wherein the at least one arm carries at least one spool, the first structure is in the form of a polygon, having an upper face, a lower face, a front wall, a rear wall comprising at least one door, and opposed lateral sides, and includes a feeder device suitable to allow the feeding of the thread developed by the at least one spool with at least one characteristic, selected from the characteristics of tension and speed, maintained constant and equal to a preset fixed value or function of the operational phase of the machine, said first structure adapted to be modularly coupled to other similar structures to allow the feeding of more yarn to a textile machine, every yarn fed by every modular element having its own selected characteristic defined by the feeder device associated with such modular element.

2. Modular element according to claim 1, wherein the first structure is delimited by sections or profiles defining an inside hollow, said sections including coupling elements suitable to permit the overlap on the aforesaid first structure of said other similar structure or the overlap of such first structure on said other similar structure or face to face of the first structure with said other similar structure.

3. Modular element according to claim 2, wherein the coupling elements are mechanical coupling devices.

4. Modular element according to claim 2, wherein the coupling elements are mechanical coupling devices selected from the group consisting of pins and recesses or magnetic coupling devices.

5. Modular element according to claim 1, wherein the at least one arm comprises a plurality of arms, mobile in association with the structure, wherein the at least one spool comprises a plurality of spools, and wherein each of the plurality of arms carries at least one spool of the plurality of spools.

6. Modular element according to claim 5, wherein each of the plurality of spools comprise threads, the threads of the plurality of spools being connected with a head-tail methodology.

7. Modular element according to claim 5, comprising a plurality of spools located on each arm, said plurality of spools located on each arm being connected with head-tail mode, the spools of the two arms also being connected together with head-tail mode.

8. Modular element according to claim 5, comprising a detection means suited to detect an occurrence of an end of thread on one said spool and a start of using the thread from the other said spool.

9. Modular element according to claim 8, wherein the detection means comprises a sensor device suitable to communicate with a control unit, suited to flag the occurrence of end of thread on one spool and the start of using the thread on the other spool, said flagging occurring through one selected from the group consisting of visual detection elements, acoustic detection elements, and combinations thereof, associated with the first structure.

10. Modular element according to claim 8, wherein the detection means comprise a sensor device connected to a remote control unit suitable to gather the information of the end of thread occurrence on one spool and the start of using the thread from the other spool, said information useable producing a warning of end of thread on such spool, the information being also usable to gather data related to the number of spools used and finished or for the traceability of the production.

11. Modular element according to claim 10, wherein the connection to the remote control unit is obtained through the feeding device or through the control unit to which such device is connected.

12. Modular element according to claim 11, wherein said control unit is inserted into the feeder device and defines the feeder device control unit.

13. Modular element according to claim 10, wherein such modular element is serially connected to the remote control unit.

14. Modular element according to claim 10, wherein a serial connection obtained via a wireless connection connects the sensor device to the remote control unit.

15. Modular element according to claim 10, wherein the feeder device includes a rotating actuator and a tension sensor connected to a thread feed control unit, said unit controlling the selected characteristic of the thread developed by the spool supported by the modular element based on the data obtained from said rotating actuator and said tension sensor, said sensor device and said actuator and the control unit defining a closed control loop of the thread feed that is unwound from the aforesaid spool direct to the textile machine, so as to feed said thread at constant speed or at constant tension.

16. Modular element according to claim 8, wherein the detection means comprise a sensor device suitable to communicate with a control unit, part of the thread feeder device, suited to flag the occurrence of end of thread on one spool and the start of using the thread on the other spool, said flagging occurring through visual and/or acoustic detection elements associated with the first structure.

17. Modular element according to claim 1, wherein the selected characteristic is kept constant at a fixed value for the entire operational phase of the textile machine or depends on the particular operational phase of this machine.

* * * * *